United States Patent [19]

Samuels

[11] Patent Number: 5,013,019

[45] Date of Patent: May 7, 1991

[54] COLLATING SYSTEM AND SIGNATURE FEEDER WITH EMBEDDED PRINTER

[75] Inventor: Michael D. Samuels, Buffalo Grove, Ill.

[73] Assignee: Print Controls Corporation, Buffalo Grove, Ill.

[21] Appl. No.: 323,358

[22] Filed: Mar. 14, 1989

[51] Int. Cl.[5] ..... B41F 13/54

[52] U.S. Cl. ..... 270/1.100; 270/54

[58] Field of Search ..... 270/1.1, 4, 52, 53, 270/54, 55, 57, 58

[56] References Cited

U.S. PATENT DOCUMENTS

| | | | |
|---|---|---|---|
| 3,819,173 | 6/1974 | Anderson | 270/1.1 |
| 3,953,017 | 4/1976 | Wise | 270/54 |
| 4,121,818 | 10/1978 | Riley | 270/54 |
| 4,674,052 | 1/1987 | Wong | 270/54 |
| 4,778,167 | 10/1988 | Snow | 270/53 |

FOREIGN PATENT DOCUMENTS

3421208A1 12/1985 Fed. Rep. of Germany ..... 270/1.1

*Primary Examiner*—John T. Kwon
*Assistant Examiner*—Therese M. Newholm
*Attorney, Agent, or Firm*—Sitrick & Sitrick

[57] ABSTRACT

In accordance with the present invention, a printer is embedded in any one, or more, signature feeder, for directly printing on a signature form coming out of that feeder. The printer is not on the collating conveyor, nor between signature feeders as in prior systems.

This provides for precisely controlled printing, on the form, a label or on the spine.

This provides a signature collating system having selectively controllable printing on the signature form coming out of the signature feeder.

22 Claims, 3 Drawing Sheets

COLLATING SYSTEM AND SIGNATURE FEEDER WITH EMBEDDED PRINTER

BACKGROUND

This invention relates to a signature collating and binding system with selectively controllable signature feeders, printers, and other apparatus, and to a signature feeder with embedded printer.

Selective actuation of signature feeders by coded subscriber information is a known procedure which allows a single collating and binding system to simultaneously build different versions of a book of signatures, such as different editions of a magazine. A book of signatures, as is conventional, is any collection or group of signatures, each signature being composed of one or more sheets. The group of signatures can be progressively built up, one signature being laid over another signature. The outer signatures are overlaid upon the inner signatures in an aligned manner. The thickness of different books of signatures will randomly vary, depending on which feeders or inserters were actuated in response to the special interests of the subscribers. A book thickness caliper and circuit can continuously compare a detected book thickness with the book thickness which should have been selected under control of the coded information.

Any error, as detected by the caliper or by sensors at the signature feeders, causes the defective book to be rejected, and reordered. An example of such a system is disclosed in Abrams et. al. U.S. Pat. No. 3,899,165 issued Aug. 12, 1975 and assigned to the present assignee.

The mailing labels which are placed on each book of signatures must correspond to the coded information which produced the customized books of signatures. This has been accomplished in the past by reading preprinted labels to develop the coded information, or by storing the coded information on magnetic tape which is read and later controls a printer which prints the mailing information directly on the books of signatures. Printers have also been associated with card inserters, located after the signature feeders and before the stitcher, to print custom information such as renewal information on a loose card before it is inserted in an already constructed book of signatures. The card can be bound in by a paster to prevent its being lost from the book of signatures associated therewith.

Defective books as detected by a caliper or by sensors associated with the signature feeders or other devices along the collating line have been automatically rejected. The resulting empty space on the collating conveyor may be filled, as taught in the Abrams et. al. patent, by a replacement book of signatures. In other systems, a rejected book causes a new book of signatures to be automatically reordered. If preprinted labels are utilized, the label is rejected and a different means of printing the mailing label of the reordered book is used, such as an on-line printer. Rejected books can be reordered immediately if the zip code currently being produced can still be maintained; otherwise some special handling procedure is necessary such as to divert the reordered book when it reaches an output area. The entire collating system has been controlled by computers and/or programmable controllers as well as hardwired circuitry.

Additionally, there are physical size limits to the ability to print on groups of signatures as they pass between signature feeders, and variance in thickness of different groups of signatures can adversely affect print quality. Furthermore, printing of labels and cards, on or off line, and printing between signature feeders does not allow for printing perpendicular to the spine of a signature, or a group of signatures.

The printing of labels and cards involve adapting conventional printers to the different requirements of a collating line. Often the labels and cards are printed off line, and are then applied to a book of signatures or inserted therein. If the printer should malfunction, the resulting defective book may be sent out as there has been no error detection means corresponding to the calipers and limit switches which detect other types of errors on the collating line. However, an error in a mailing label can be more serious than an error such as the addition or deletion of a signature from a book of signatures.

Despite the use of computers and programmable controllers, considerable manual attention to the binding line is necessary. As the hoppers for signatures becomes low, they must be filled to allow continuation of the operation. This is especially critical for the standard book replacement feeder, in which the number of replacement books needed cannot be reasonably estimated in advance, as it will vary depending on the number of random rejects which occur during the collating and binding operation.

While the above systems are versatile in producing different editions of magazines or the like during a production run, they suffer from a number of disadvantages. The contents of the different editions or variations are still controlled entirely by the signature which are loaded in the signature feeders. Since the number of signature feeders reaches a practical maximum, there is a limit to the variations which can be produced in concurrently run books of signatures.

In U.S. Pat. No. 4,121,818, one solution to some of these problems is proposed. A noncontact printer is located within a collating line, between adjacent signature feeders, to custom print information on the signatures fed from upstream feeders. The downstream feeders then deliver signatures over the printed signature, and the books are then bound, so that one or more intermediate signatures in the bound books have custom printing. A second non-contact printer, located after the trimmer prints mailing labels under control of the mailing coded data. Both noncontact printers may be of the dot matrix type, such as ink jet, which print along one direction only. Movement of the collating conveyor provides the other direction needed to form characters by a matrix of dots.

Each printer is followed by an optical scanner which detects the absence of characters in any line where a character should have been printed. The scanner automatically compensates for background variations in the surface against which the characters are printed. Any errors result in rejection of the book of signatures.

A replacement book feeder contains standard books of signatures which are selectively fed into empty conveyor spaces resulting from the rejection of defective books. When the standard books in the hopper fall below a predetermined level, new standard books are automatically reordered and are automatically diverted off the conveyor and into the hopper. When a book is rejected, the computer determines whether it should be reordered immediately, or should be replaced by a standard book.

SUMMARY

In accordance with the present invention, a printer is embedded in any one, or more, signature feeder, for directly printing on a signature form coming out of that feeder. The printer is not on the collating conveyer, nor between signature feeders as in prior systems.

This provides for precisely controlled printing, perpendicular to the spine on any form.

One object of the present invention is the provision of a signature collating system having selectively controllable printing on the signature form coming out of the signature feeder. Additionally, another object of this invention is the provision of a signature feeder having an embedded printer.

Since imaging is always done in the feeder, the printer will always be a constant distance from the form to be printed. This is especially useful in selective binding, where in previous systems due to the varying thickness of booklets, the distance between the inkjet imager and the surface to be imaged varied, leading to a poor quality image. The solution to this problem in previous systems has been to image from underneath the product. This leads to difficult operator set-up as well as imaging far from the spine.

Also, since printing is done on the single signature before combination with other signatures, an error does not result in wasting an entire group of signatures. Also, variable data information is easily accommodated with the present invention.

Previous systems which print on the collating conveyor have certain disadvantages related to chain stretch of the conveyor. These disadvantages have been overcome with the present invention.

BRIEF DESCRIPTION OF THE DRAWINGS

The present invention may be more easily understood by reference to the drawings and the detailed description thereof, wherein.

DETAILED DESCRIPTION OF THE DRAWINGS

Figure 1:
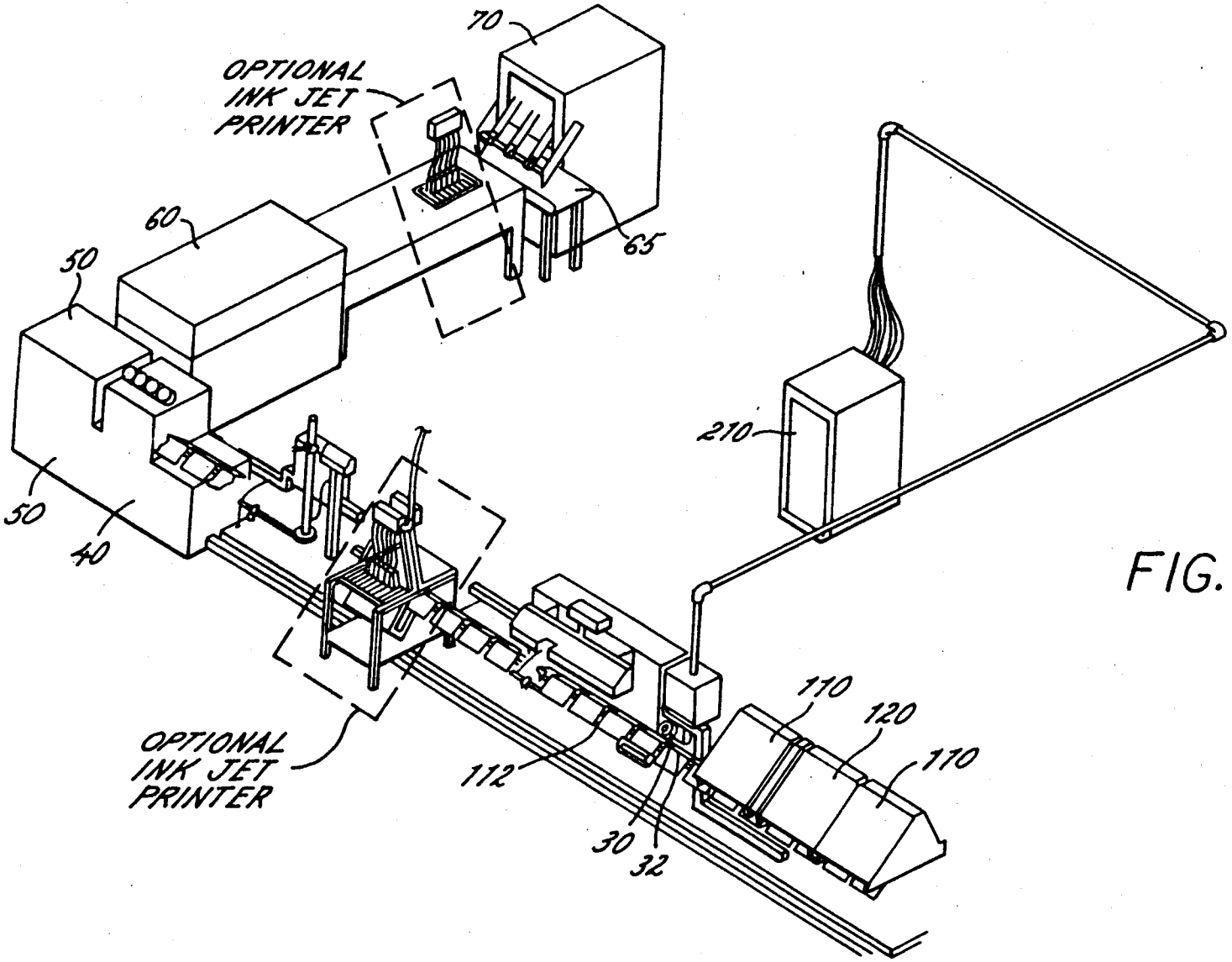
FIG. 1 illustrates a block diagram of a collating system in accordance with the present invention.

FIG. 1, a collating and binding system is illustrated for a saddle binder or stitcher line. Such a system includes from one to a large number of signature feeders or inserters 110. For clarity, only three feeders are illustrated. Additionally, the system includes one, or more, signature feeder with embedded printer 120.

Figure 2:
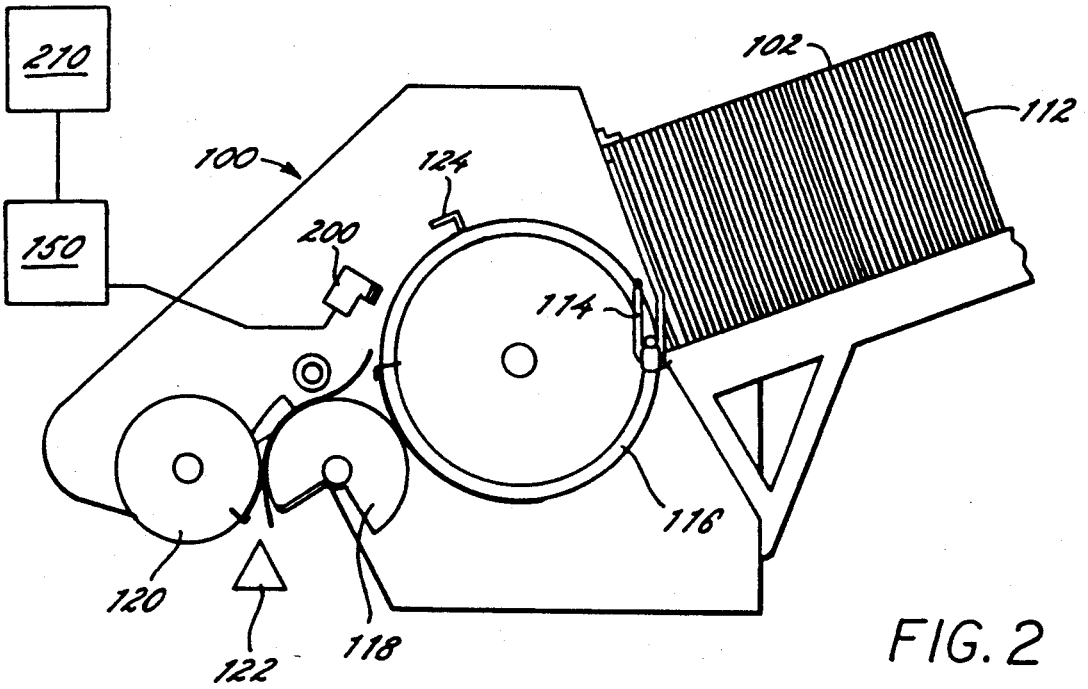
FIG. 2 illustrates the structure and assembly for the feeders, including the optional embedded signature printer.

Referring to FIG. 2, a core signature feeder, 100, common to both signature feeders 110 and 120 is illustrated. Each feeder has a magazine 102 for storing a plurality of signatures 112, each signature being composed of one or more sheets. Individual signatures are seized by a vacuum sucker 114 and are conveyed by a primary cylinder 116 to a transfer drum 118 and an opener drum 120 onto a collating conveyor chain 122.

When a vacuum pressure control is actuated, the next signature 112 is transported in the cylinder 116, and it contacts a detector switch 124 which, in the case of a saddle binder line, may comprise a missing signature switch which produces an error signal when the feeder has failed to deliver a signature. For other types of collating and binding lines, switch 124 may take other forms, such as a double signature detector actuated when two signatures are fed in response to one feeder actuation. The above described feeder station is conventional and may take the detailed form shown in Abram et. al. U.S. Pat. No. 3,899,165 or may take other forms.

The conveyor chain 122 is driven by a chain motor in order to convey each conveyor station adjacent each of the feeders. It should be understood that several separate chains and associated chain motors may be provided throughout the entire system, and operated in synchronism so as to effectively form a continuous collating conveyor.

In alternate embodiments, other types of feeders and transfer means 118 can be used. The transfer drum 118 illustrates one means for moving a signature through a feeder. Other alternative feeders may also be used, such as a shuttle feeder, a rotary feeder, etc.

Figure 3:
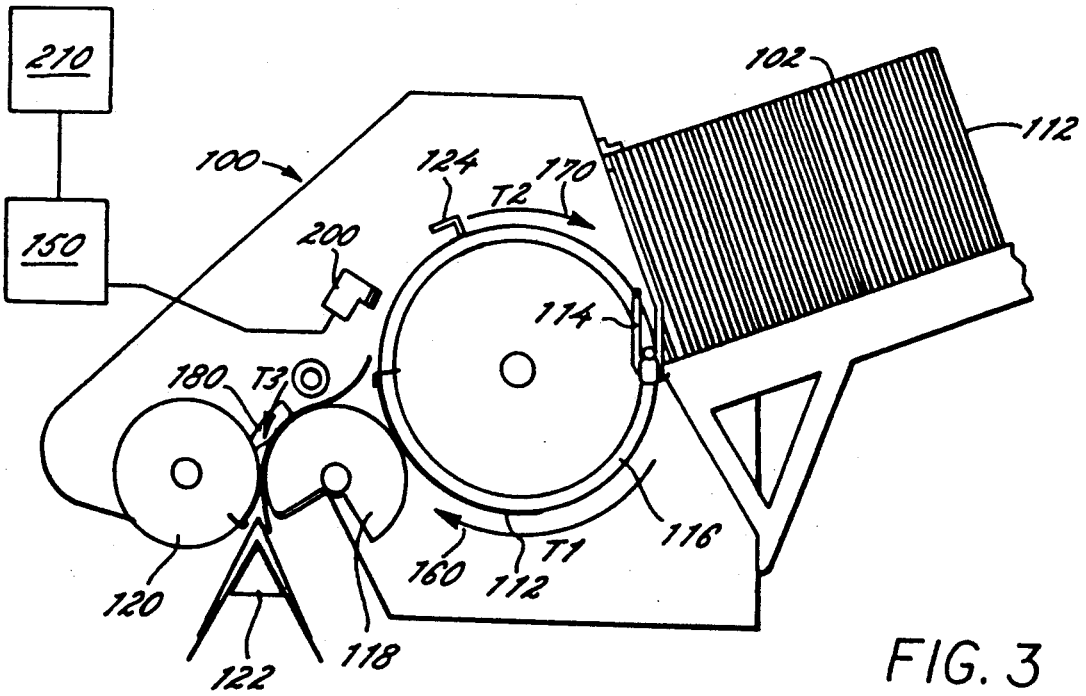
FIG. 3 illustrates the feeder with embedded signature feeder, paper transfer and printing flow of operation.

As shown in dashed line form FIG. 2, a printer 150 including print head 200 is embedded in the signature feeder 120, distinguishing it from the standard signature feeder 110. The printer can be located adjacent any of the cylinders or drums 116 or 118, where the print head 200 is on a perpendicular to a tangent of the drum which will carry the signature to be printed on. As illustrated in FIGS. 2, and 3, the print head is located adjacent the cylinder 116.

Referring to FIG. 3, the time flow versus placement with the signature feeder 120 for print operation is illustrated. At time T1, the signature form 112, is wrapped around cylinder 116 and moves thereupon in the direction indicated by the arrow 160. At time $t_2$, the signature form 112 is moved about cylinder 116 in the direction indicated by the arrow 170. During time $t_2$, the printer 150, under the control of a controller system 210 causes print head 200 to print on the signature form 112.

Printing can be done anywhere on the face of the signature form. At time $t_3$, the signature form 112 travels from the signature feeder to the conveyer 122, in the direction indicated by the arrow 180.

The print head 200 can be comprised of one or a plurality of print heads, which can be controlled to print a matrix of dots, such as to form characters.

Since printing is done uniformly on one signature, printing can always be done at the same distance. This is an advantage for selective mode. The signature is conveyed adjacent the printer heads 200 which are controlled to print a matrix of dots, each matrix forming a character, directly on the exposed signature. Where there are multiple printer heads each one prints a different line as the signature is moved past the head by the cylinders, 116 and transfers means 118. The signature can then be passed by an optical scanner with an optical detector. If the detector does not detect a character in a line when a character should have been printed by the printer head 200, an error signal is generated to indicate a defective book.

The signature with custom printing, after passing the scanner, can then travel past optional additional downstream feeder stations which cover the printed signature with new signatures stored in the magazines of those stations. As the conveyor chain continues, signatures are selectively delivered in order to progressively build books of signatures which have individual variations. Additional printers, and respective additional scanners may be located along the feederline, as desired, to custom print information throughout a book (i.e. group) of signatures.

A label printer can be coupled to the same source means as the signature printer. The label printer selectively prints the same subscriber information as the signature printer had when the corresponding group of signatures was adjacent to the corresponding signature printer. The label printer can be an embedded signature printer or other in-line and/or non-embedded printer. The label is usually printed on the outside signature.

Referring again to FIG. 1, after leaving the line of feeders 110 and 120, the conveyor stations are driven past a master book caliper 30 which includes a caliper probe 32 with a sensor which generates a signal directly proportional to the actual thickness of the adjacent book of unbound signatures. A control switch produces an output signal when the probe 32 is contacting that portion of the book which will provide valid thickness information. This output signal enables the signal from the sensor 32 to be passed to the control system 210 for use in determining whether the measured thickness corresponds with a calculated thickness based on the number of signatures which were to have been fed by the signature feeders 110 and 120.

After passing the caliper station, each book of signatures reaches a stitcher 40 which may include one or more conventional stapler mechanisms for securing together the book of signatures. The stitched or stapled book of signatures is conveyed to a diverter 50 which, in response to actuation of a solenoid diverts the book either onto a trimmer 60 operated in synchronism with the signature chain 122, or onto a reject book station. The books not rejected are trimmed by a conventional trimmer 60 and then conveyed to a stacker 70.

If a book is rejected, a substitute book is ordered up by the control system 210, and depending at what point in time it is rejected, is selectively added to a stacked group 70 or separately grouped via Diverter 65.

One embodiment of a collating system having reorder is comprised of: a plurality of feeder means, at least one of said feeder means further comprised of an embedded printer, said feeder means selectively actuable to deliver signatures to a conveyor to progressively build groups of signatures; source means for establishing coded data which controls actuation of the feeder means to build different groups of signatures in response to different coded data; reject means for rejecting a defective group of signatures; and, reorder means for selectively actuating the feeder means, responsive to the coded data corresponding to a rejected group of signatures, to progressively rebuild the same group of signatures as rejected.

The collating line may include additional processing or handling devices of a standard nature, not illustrated, such as a thin book reject station in advance of the diverter, a long book of hanging book detector, loose card inserter, and other devices depending on the nature of the operations being performed.

Figure 4:
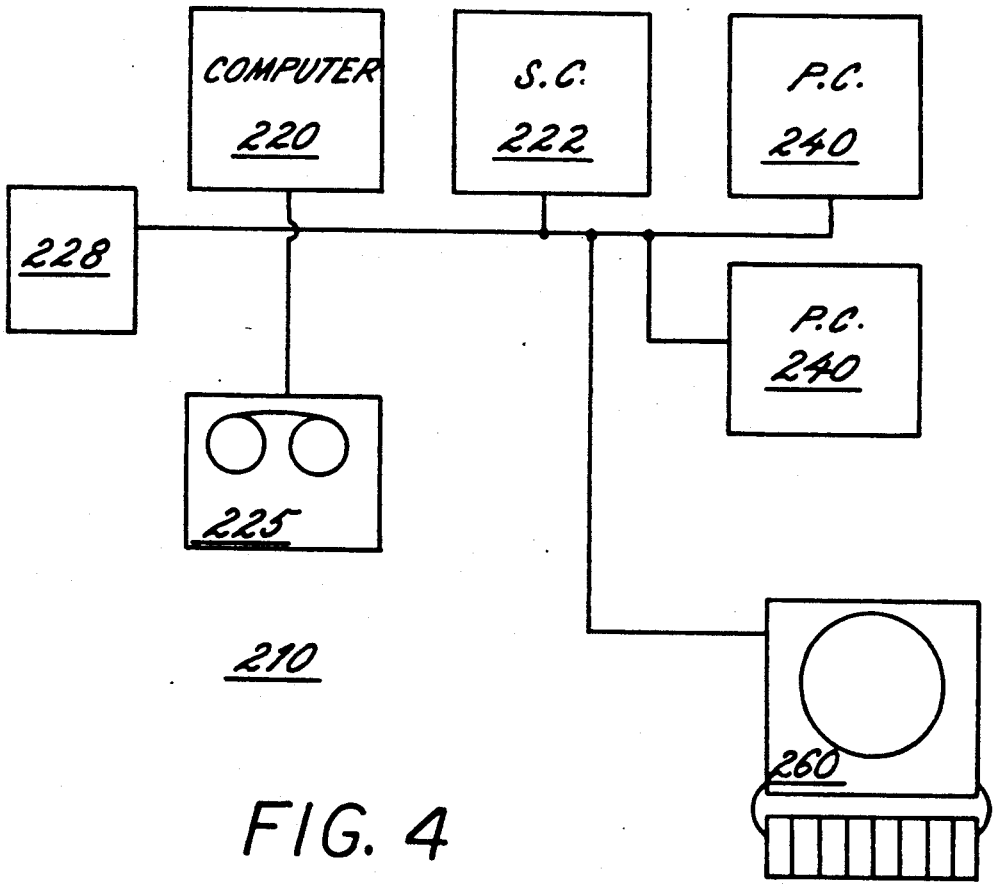
FIG. 4 illustrates the control system 210 in greater detail.

Referring to FIG. 4, the control system 210 for the collating and binding system is illustrated and includes, in part, a computer 220 and a programmable controller or slave computer 222 which contain the control programs to be described. A number of special controllers 240, in conjunction with the programmable controller 222, may additionally provide the interface between the devices on the collating line and the remainder of the control system, or this interface can be internal to the computer 220 or 222.

Control information as to the signatures to be delivered for each particular subscriber is supplied by coded information contained on a magnetic tape read by a mag tape reader 225, which can be stored in any of many ways. For example, each subscriber can be identified by name, address, city, state, zip code, a special identification which indicates the particular signatures which are to be contained in the book of signatures delivered to that subscriber, and other information.

An operator console 260 allows an operator to communicate with, program, and otherwise interact with the system. For example, the user/operator can manually enter the correlation between the special I.D. and the particular feeders which are to be actuated each time that code is present. The Special I.D. code generally can provide demographic information, coded in a manner generally selected by the publisher. Thus, the operator console 260 allows entry of any publisher's code into the system.

Information as to the location of all conveyor stations is provided by an encoder 270 (see FIG. 1) which monitors the conveyor 122. Each time the encoder 270 generates a new coded signal, the computer 220 receives an interrupt which is serviced to cause both input and output signals to be generated to all devices along the collating line which need servicing at that time. The computer 220 is informed at all times of the location of each signature station throughout the collating system, and controls all operations associated with each collating station as it progressively travels along the conveyor 122.

For clarity, FIG. 4 illustrates only block components of the control system. The control system Computer 220 may be any minicomputer or microcomputer, and includes a CPU, a memory external mass storage as desired, and support I/0, which are tied to a bus . For operator communications in addition to operator console 260, additional communications devices can be connected to the bus or to separate communication ports 228.

The print heads 200, of FIGS. 1, 2 and 3, are desirably of the noncontact, dot matrix type. Examples include ink jet, laser printers, and other non-contact printers.

The ink jet printer contains a nozzle or array of nozzles having an ink input line from a pressurized ink source. The nozzle is connected to an ultrasonic drive signal source in the ink jet controller. The droplets of ink from the nozzle pass a charging tunnel connected to a charging signal source. The charged droplets then pass deflection plates which are connected to a deflection signal source which has a signal whenever a character is to be formed. The description which follows refers to an ink jet printer embodiment.

When no deflection signal is present at the deflection signal source the droplets are captured by a sensor tube and exit at an outlet which leads to an ink return. The sensor tube is coupled via a line to an automatic phase control. Ink jet printers of this type are commercially available from numerous manufacturers, such as from Domino, Diconix, etc. The ink jet controller has an input from an encoder, which detects the movement of an adjacent signature 112.

Referring to FIG. 3, the deflection signal source deflects the dots of ink along a direction which is transverse to the direction of the movement 170 of the signatures 112. In conjunction with the movement of the signature 112 along direction 170, a $5 \times 7$ matrix of dots is formed which prints any alphanumeric character.

The ink supplied to an input line may be a water based ink having a two to four second drying time, or a solvent based ink having a one-half second or less drying time. In the case of a water based ink, the collating line must allow 3 feet to 4 feet of travel for the signature 112 before another signature is fed thereover and before the character comes in contact with some member which could smear the ink. While an ink-jet printer has been illustrated, it will be appreciated that a contact printer having a plurality of actuable dot producing wires could also be utilized. By using the motion of the signature within the feeder as an integral part of the printing process, the complexity of the printer can be greatly reduced.

In one embodiment, as the signatures pass a leading photoelectric detector, for the signature feeder printer 20, an interrupt is generated which, at the appropriate time of servicing the tasks, passes control to a printer task. Decision logic determines whether the particular printer (sig or label) being serviced has finished the last book. If affirmative, the logic increments the pointer to the next book memory address.

While the information transmitted to the ink-jet controllers is typically the mailing information, it will be appreciated that additional information may be stored for transmission to the printers. Particularly the memory may store additional information of any type, such as information related to the demographic code.

By chaining such additional information special custom printing directed to particular subscribers or classes of subscribers can be printed within interior signatures of the books of signatures.

Although this invention has been described with reference to the illustrated embodiments, this description is not meant to be construed in a limiting sense. Various modifications of the disclosed embodiments, as well as other embodiments of the invention, will become apparent to those skilled in the art upon reference to the drawings and description of the invention. It is therefore contemplated that the appended claims will cover any such modifications as fall within the true scope of the invention.

What is claimed is:

1. A collating system comprising:

a plurality of feeders each comprising transfer means, at least one of said feeders is further comprised of an embedded printer, for selectively printing wherein said printing is performed as the transfer means moves the signature past the printing head, said feeder selectively actuatable to deliver signatures to a conveyor to progressively build groups of signatures, source means for establishing coded data which controls actuation of the feeders to build different groups of signatures in response to different coded data.

2. The system as in claim 1 further comprising:

reject means for rejecting a defective group of signatures,

3. The system as in claim 2 further comprising:

reorder means for selectively actuating the feeder means, responsive to the coded data corresponding to a rejected group of signatures, to progressively rebuild the same group of signatures as rejected.

4. The collating system as in claim 1 further characterized in that the embedded printer prints information on the signature fed from its respective feeder means, responsive to the source means.

5. A collating system for gathering groups of signatures with selected signatures of the groups having customized printing comprising:

collating conveyor having spaced stations which sequentially receive signatures;

a plurality of feeders, each comprising transfer means for moving a signature through the feeder, spaced along the collating conveyor for delivering signatures to adjacent stations of the collating conveyor;

source means synchronized with the operation of the collating conveyor for sequentially coupling to the signature printer means respective information which is to be printed on the signatures fed from a respective feeder; and signature printer means located within at least one of said feeders and having a printer head for printing information on the signature fed from the feeder, responsive to the source means, wherein said printing is performed as the transfer means moves the signature past the printing head.

6. The system as in claim 1 wherein said selected signatures are internal signatures of the group.

7. The system as in claim 1 wherein said selected signature are outer signatures of the group.

8. The system as in claim wherein said groups of signatures are progressively built into groups.

9. The system as in claim 1 wherein said information is variable data.

10. The system as in claim 1 wherein there are more than one feeder means having signature printer means located therein, wherein each respective signature printer means is fed separate respective information.

11. The collating system of claim 5 wherein the source means contains a series of different subscriber information, means for coupling at least a portion of the subscriber information to the signature printer means for printing different information on successive groups of signatures, and label printer means coupled to the source means for printing mailing information based on the same subscriber information which controlled the signature printer means when the corresponding group of signatures was adjacent to the signature printer means.

12. The collating system of claim 5 wherein the printer head comprises a noncontact printing head spaced from the signature to be printed, and means for forming printed characters in accordance with the information from the source means.

13. The collating system of claim 12 wherein said printer head is further comprised of an ink jet printer.

14. The collating system as in claim 12 wherein said printer head is further comprised of a laser printer.

15. The collating system of claim 13 wherein for each feeder which has the signature printer therein, the noncontact printing head prints along a direction transverse to the direction of movement of the signature along the transfer means.

16. The system as in claim 5 wherein said transfer means is comprised of a shuttle feeder.

17. The system as in claim 5 wherein said transfer means is comprised of a rotary feeder.

18. The system as in claim 5 wherein said transfer means is comprised of a transfer drum.

19. A collating system comprising: a conveyor having a direction of movement adjacent a plurality of feeders each having a transfer means which deliver signatures to adjacent stations spaced along the conveyor to progressively build groups of signatures, processing means adjacent the conveyor for processing the groups of signatures to provide output groups of signatures, source means for generating characters which are to be printed on the groups of signatures, and at least one of said feeders further comprising an embedded dot matrix printer head adjacent the transfer means for printing on an adjacent signature a plurality of dots along a direction transverse to the direction of movement of the signature, a matrix of dots being formed as the signature moves past the dot printer head, the printer head being coupled to the source means for selectively printing dots in a matrix which forms the characters to be printed, wherein said printing is performed as the transfers means moves the signature past the printer head.

20. The system as in claim 19 wherein said printer head is operated in synchronism with the conveyor responsive to the source means.

21. The system as in claim 19 further comprising: reject means for rejecting a defective group of signatures.

22. The system as in claim 21 further comprising: reorder means for selectively actuating the feeder means, responsive to the coded data corresponding to a rejected group of signatures, to progressively rebuild the same group of signatures as rejected.

* * * * *